United States Patent [19]

Andronov et al.

[11] 4,004,616

[45] Jan. 25, 1977

[54] WOVEN BAND

[76] Inventors: Mikhail Alexandrovich Andronov, ulitsa Rusakovskaya, 39/43, kv. 32; Anatoly Nikolaevich Bakun, Sevastopolsky prospekt, 36, kv. 53; Felix Evgenievich Mezhevich, Rostokinsky gorodok, 6 linia, 17, kv. 84; Mikhail Ivanovich Petrov, Sevastopolsky prospekt, 17, korpus 2, kv. 39; Jury Ivanovich Belov, ulitsa 15 Parkovaya, 16, korpus 1, kv. 68, all of Moscow, U.S.S.R.; Alexandr Yakovlevich Feldman, deceased, late of Moscow, U.S.S.R.; by Raisa Alexandrovna Feldman, administratrix, ulitsa Bashilovskaya, 10, kv. 14, Moscow, U.S.S.R.

[22] Filed: June 18, 1974

[21] Appl. No.: 480,495

[52] U.S. Cl. ..... 139/383 R; 139/416; 139/426 R

[51] Int. Cl.[2] ..... D03D 15/00

[58] Field of Search ..... 139/383 R, 384 R, 426 R, 139/420 R, 416, 417, 411; 280/150 SB; 87/6

[56] References Cited

UNITED STATES PATENTS

| | | | |
|---|---|---|---|
| 835,083 | 11/1906 | Strahl | 139/417 |
| 2,272,229 | 2/1942 | Tucker | 139/383 R |
| 2,471,166 | 5/1949 | Neff | 139/383 R |
| 2,794,450 | 6/1957 | Gatzke | 139/411 |
| 2,797,712 | 7/1957 | Shapiro | 139/383 R |
| 3,073,209 | 1/1963 | Benk et al. | 87/6 |
| 3,463,202 | 8/1969 | Wildi et al. | 139/383 R |
| 3,530,904 | 9/1970 | Ballard | 139/383 R |
| 3,612,110 | 10/1971 | Wildi et al. | 139/383 R |
| 3,756,288 | 9/1973 | Seo et al. | 139/383 R |
| 3,823,748 | 7/1974 | Allman et al. | 139/383 R |
| 3,926,227 | 12/1975 | Takada | 139/383 R |

*Primary Examiner*—James Kee Chi
*Attorney, Agent, or Firm*—Holman & Stern

[57] ABSTRACT

A woven band particularly for use in safety belts for drivers and passengers of transport vehicles.

The band is provided with warp yarns with different relative elongation characteristics, and weft yarns interwoven with the warp yarns. The warp yarns with lesser relative elongation is interwoven between the rest of the warp yarns having high elongation and strength so as to form on the band surface at least one distinguishable uniform strip, with the ratio between the relative elongation of the yarns of the strip to the elongation of the rest of the warp yarns being less than the ratio of the ultimate tensile force of the band to its actual breaking force.

3 Claims, 2 Drawing Figures

WOVEN BAND

BACKGROUND OF THE INVENTION

The present invention relates to textile materials and, more particularly to woven bands.

The invention may be utilized to the best advantage in safety belts for drivers and passengers of transport vehicles, for example, automobiles. It is equally applicable, however, as a load-carrying means in loading operation, in which it is of vital importance to check the effects of overloads which may subsequently lead to the breading of a load-carrying means.

Safety belts are, at present, extensively used by atuomobile drivers and passengers and have proven to be an important factor which accounts for a substantially reduced death rate caused by accidents; they also may be an aid in the mitigation of the consequences of accidents.

However, the band for a safety belt can withstand only once a considerable tensile force which absorbs the maximum amount of the kinetic energy caused by an automobile accident.

Loads which exceed the limiting magnitude for a given band result in irreversible changes in its structure which sharply reduce the strength and energy absorption capacity of the band in case it is subjected to another significant stress.

This said load limit may occur in relatively minor accidents which in themselves may not be dangerous to the driver and passengers or to the automobile.

Because of the comparatively high cost of safety belts, car and truck owners who have been victims of a road accident try to spend as little as possible to repair the damage. In many cases they do not replace, as they should, safety belts subjected to overloads, partially because of the fact that a car or truck owner has no way of knowing whether the stress taken by the belts in an accident has been in excess of the limiting magnitude. In view of the above, it is of an urgent necessity to provide safety belts having built-in overlaod indicators which ensures 100% detection of belts having been subjected to overloads. This will apprise owners of transport vehicles to immediately replace worn-out belts. Furthermore, this enables traffic police to check the state of the safety belts. Safety belts manufactures will be spared unjustified discredit with respect to their products, and suits brought against them by relatives of those who have died in road accidents because of defective safety belts will be rendered obviously unfounded.

PRIOR ART

There have been attempts to solve this vital problem with the aid of dynamometric devices of the limiting type, for example, indicators built into the metal reinforcement of a belt. A device of this type proved to be impractical due to their complexity.

There are also woven bands for safety belts known for drivers and passengers of transport vehicles, comprising warp yarns having different relative elongations at rupture and weft yarns interwoven with the warp yarns (cf.Federal Germany Application Offenlegungschrift No. 1,910,288, Cl.86c, 21 of Feb. 29, 1968).

The band of the above-mentioned application has warp yarns with a different carrying-capacity and a different relative elongation at rupture, the yarn having the least elongation at rupture being arranged between layers of the weft yarns without emerging to the surface of the band, whereas the warp yarns with greater carrying capacity and greater elongation at breakage emerges to the band surface, and is interwoven with the weft yarns.

The band of the above application ensures a greater energy absorption than the band in which all the yarns have equal relative elongation, yet a disadvantage thereof resides in the impossibility of establishing, just by a look at the whether the rupture of the individual warp yarn threads or the rupture of the entire warp yarn, with such rupture makes the band unsafe.

OBJECTS AND SUMMARY OF THE INVENTION

It is an object of the present invention to provide a woven band for safety belts for drivers and passengers of transport vehicles which allows the fitness of safety belts for further use a matter of usual observation.

It is another object of the invention to provide a woven band for safety belts which makes it possible to employ a broader range of indicator strip yarns differing in relative elongation at rupture or breakage.

The above and other objects of the present invention are attained by the fact that in a woven band comprising warp yarns with different relative elongations at rupture, the warp yarns being interwoven with the weft yarns, the warp yarns with lesser relative elongation having low rupture strength and being interwoven, in accordance with the invention, between the rest of the warp yarns having high dongation and strength so as to form on the band surface at least one distinguishable uniform strip, with the ratio of the elongation of the yarns of said strip to the elongation of the rest of the warp yarns being less than the ratio 8 the ultimate tensile force of the band to its actual breaking force; as a result of which strip is ruptured, when the band is stretched by a force exceeding a specified limit value thereof, and serves as an indicator of the fitness of the band for further use.

Such a band makes possible visual checking of its fitness for further use because the indicator strip yarn is ruptured as the band is subjected to a limiting tensile force, thus forming on the band's surface portions with ruptured yarn ends.

It is expedient that the ratio between the relative elongation of the indicator strip yarns and to the elongation of the rest of the warp yarns be less by 1 to 5 per cent than the ratio of the ultimate tensile force of the band to its actual rupture force at the maximum value of said former ratio, and a minimum value of said latter ratio caused by the non-stability of the band manufacturing conditions.

The above value of 1 to 5 per cent is selected so as to take care of unpredictable variations in the yarn properties beyond the limiting relative elongation values guaranteed by the manufacturer. This is meant to ensure that the indicator strip yarns are ruptured with the band withstanding a load which is not in excess of the limiting one.

The above expression "non-stability of the band manufacturing conditions" is to be understood as unavoidable variations in mechanical properties both within a given batch of yarns and band, and in different batches, which may be caused by inherently different thickenss and structure of the yarns.

In certain cases, it is also expedient that the indicator strip yarns be woven into the band with a different degree of preliminary stretch, as compared to the rest of the warp yarns. This makes it possible to ensure the indicator's operation in response to a certain force applied thereto without changing the already selected yarns, and which equally applies to cases in which the most suitable type of yarns out of those available has an elongation degree which is different from the required one.

The band may also have, according to the invention, a number of indicator strips. In this case, the middle of an extreme strip on each side is to be spaced from the band's edge at a distance varying between ⅛ to ⅓ of the width of the band.

Any non-uniform load distribution across the band's width results in the fact that overlaods and underloads are most strongly felt at the middle and extreme portions of the band. The arrangement of indicator strips at the above-mentioned spacing from the band's edges ensures a maximum accuracy of the indicator's operation.

An indicator strip may also be a series of segments, the length of which is significantly, more than the segments.

In order to make the indicator strip more conspicuous, the indicator strip yarns are of different color and texture, as compared to the rest of the warp yarns.

The invention will now be explained in greater detail with reference to a description of a specific embodiment thereof to be read in conjunction with the accompanying drawings, wherein:

DETAILED DESCRIPTION OF THE INVENTION

Figure 1:
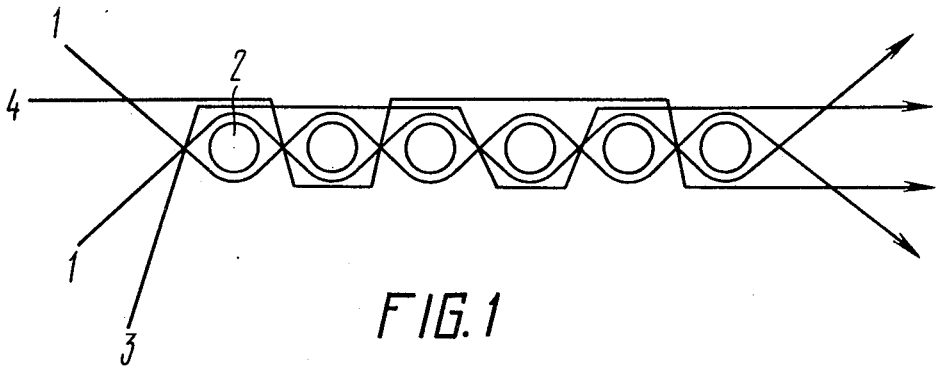
FIG. 1 is a view in longitudinal section of the present woven band.
Figure 2:
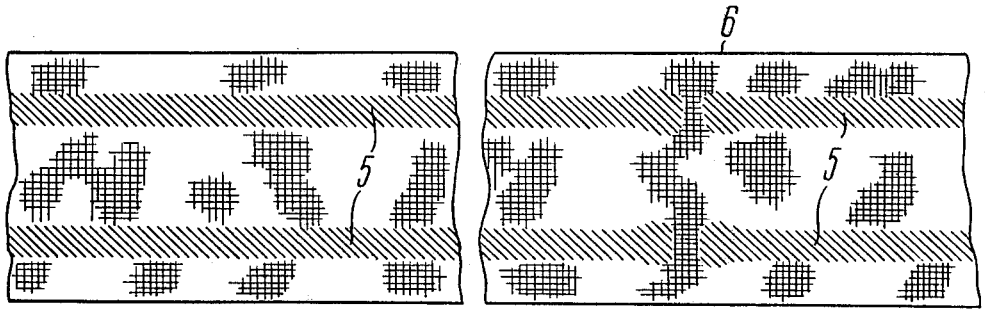
FIG. 2 is a diagrammatic view of a band sample prior to and after the application of a rupturing stress.

Referring to the drawings, the present band comprises warp yarns 1 with the greatest relative elongation at rupture, weft yarns 2 interwoven with the yarns 1, and warp yarns 3 and 4 having lesser relative elongation at rupture. The warp yarns 3 and 4 are arranged among the warp yarns 1 and uniformly pass over the weft yarn 2, thus forming distinguishable strips 5 (FIG.2). The ratio of the elongation of the yarns 3 and 4 of the strips 5 to the elongation of the rest of the yarns 1 is less by 1 to 5 per cent than the ratio of the ultimate tensile force of a band 6 to its actual rupture force. The above value of 1 to 5 per cent is selected for the maximum value of the former ratio and the minimum value of the latter ratio caused by the non-stability of the band manufacturing conditions. The foregoing values are ensured by selecting the proper yarns material, the degree of the twist of the yarns, and the degree of preliminarily stretching the indicator strip yarns. The amount of the yarns 3 and 4 is less than that of the yarns 1.

If the band is a multijoly one, the yarns 3 and 4 may be interwoven with the outer layer weft yarns 2, as well as with the weft yarns of the outer layer, and one of the intermediate layers or the opposite outer layer.

As can be seen from FIG. 2, the band 6 has two indicator strips 5 whose midpoints are spaced at a distance varying between ⅛ to ⅓ of the band's width from the edges of said.

This is explained by the fact that the portions of the band across its width are the ones least subjected to stress variations in the course of the band's elongation, which may be caused by a non-uniform load distribution across the band's width. Hence, the location of the indicator strips precisely at these portions of the band provides for maximum accuracy in determining the fitness of the safety belts for further use.

The indicator strips may be formed by segments, the length of which is significantly more than the spacing between adjoining segments.

The indicator strip yarns are of a different color than the warp yarns 1 unless their natural character makes them clearly distinguishable against the background of the latter. In order to clearly distinguish between the former and the latter, one may, for example, dye a band manufactured from an undyed material, provided that the indicator yarns strip yarns are made of an undyable material.

Presented hereinbelow are the methods of calculating the indicator strip yarns parameters with respect to the parameters (mechanical characteristics) of the yarns of the band being tested and the maximum permissible load withstood by the band. The final result of such a selection is the determination of the maximum possible relative elongation of yarns suitable for the indicator strip of the band. On the basis of the conditions set forth hereinabove, and in claim 1, the following symbolic function is obtained:

$$\frac{\Delta l_{ind.(max)}}{\Delta l_{warp(min)}} \quad \frac{P_{limit.(min)}}{P_{rupt.(max)}} (1-\delta),$$

in which $\delta = (1 - 0.05\ (1 - 5\%)$.

Transforming the above function, an empirical function is obtained which may be used for design and checking calculations:

$$\Delta l_{ind.(max)} \quad K \frac{P_{limit.(min)} \times \Delta l_{warp(min)}}{P_{rupt.(max)}},$$

in which $\Delta l_{ind.(max)}$ is the maximum relative elongation of the indicator yarns;

$\Delta l_{warp(min)}$ is the minimum value (in terms of deviation from the nominal value) of the relative elongation of the warp yarns (the prototype band and the band being manufactured);

$P_{limit.(min)}$ is the minimum limiting elongation stress for the prototype band which results in irreversible changes reducing the rupture strength at subsequent loading. (This is a mean value obtained as a result of testing a considerable number of samples);

$P_{rupt.(max)}$ is the actual maximum rupture strength value calculated as the result of testing a substantial number of samples;

K is the safety factor taking into account the unpredictable variations in the properties of the band beyond the limiting relative elongation values guaranteed by the manufacturer.

The numerical value of K is between 0.95 and 0.99. K is related to the reduction $\delta = 1$ to 5%, as indicated in the foregoing formula, i.e. $\delta = (1 - K°)$.

Assuming for instance that a prototype band is made, for example, of polyamide yarns, and further assuming that experiments have revealed the following characteristics of the band and the warp yarns:

$P_{rupt.(max)} = 3{,}000$ kg $P_{rupt.(min)} = 2{,}800$ kg
$P_{limit.(max)} = 2{,}500$ kg
$P_{limit.(min)} = 2{,}300$ kg
$\Delta l_{warp(min\text{-}max)} = 32 - 34\%$.
Assuming that K = 0.98, there is obtained:

$$\Delta l_{ind.(max)} \quad \frac{0.98 \cdot 2300 \cdot 0.32}{3000}, \text{ i.e.}$$

$$\Delta l_{ind.(max)} \quad 0.24\%.$$

From the available types of yarns, one with a relative elongation value of between 0.22 and 0.24 (22 – 24%) is thus selected.

The limiting indication stress value is determined as follows:

$$P_{ind.(max\ min)} = \frac{P_{rupt.(max\ min)} \times \Delta l_{(max\ min)}}{\Delta l_{warp(min\ max)}};$$

$$P_{ind.(max)} = \frac{3000 \cdot 0.24}{0.32} = 2{,}250 \text{ kg};$$

$$P_{ind.(max)} = \frac{2800 \cdot 0.22}{0.34} = 1.810 \text{ kg}.$$

of course, the above mechanical characteristics are only cited by way of an example, although they might correspond to an actual band made from the above-mentioned yarns and having its indicator operation within the foregoing load range. It is also clear that in an actual band made in accordance with the present invention, the variation range of the stress values at which the indicator strip is ruptured is much narrower. This is due to the fact that with a great number of parallel warp yarn threads, including indicator yarn threads, the elongation values are somewhat equalized due to the friction therebetween, whereby the instability of the properties of the material and of the geometrical characteristic of the yarns become of less influence. Testing of band samples has revealed that the variability of the load values at which the indicator strip is ruptured is no greater than from 200 to 250 kg.

It is expedient that a band with indicator strips be used as an overload indicator for an entire safety belt kit, including the lock and fixture members. For this purpose, the rupture strength is to be selected so that it is somewhat less than the limiting rupture strength of the given band and is commensurable with the standard or actual limiting rupture strength for the members limiting the strength of the safety belt taken as a whole.

What is claimed is:

1. A woven band comprising a plurality of warp threads having different relative elongations at rupture and different colors; and weft threads interwoven with said warp threads, in which a plurality of a first group of warp threads, with a lesser relative elongation, are interwoven in a first zone beside each other and between the rest of a second group of warp threads, which are rarefied within said first zone, the warp threads uniformally passing about the weft threads uniformally passing about the weft threads forming essentially two indicator strips running warpwise, distinguishable against the rest of the band and having definitely, apparent, visual-discriminating-ability across the bandwidth, centers of said indicator strips being spaced from band side edges distances equalling from between one-eight to one-third the band width the ratio of the relative elongation of the threads of the indicator strips to the relative elongation of the warp threads being less than the ratio of the tensile force critical for the band strength to its actual rupture strength, so that as a result of which, an overload of the band involves simultaneous formation of clearly visible discontinuities of the indicator strips spaced apart at a constant pitch along the length of the band, said discontinuities being formed within a narrow range of loads critical for the band.

2. A woven band as claimed in claim 1, wherein the ratio of the elongation of the threads of the indicator strips to the elongation of the rest of the warp threads is preferably between 1% to 5% less than the ratio of the tensile force critical for the band strength to its actual rupture strength.

3. A woven band as claimed in claim 1, wherein the threads of the indicator strips have a different degree of prestretching compared with the rest of the warp threads.

* * * * *